United States Patent [19]

Herstad

[11] 4,202,646

[45] May 13, 1980

[54] HELICOPTER LANDING PLATFORM

[76] Inventor: Øystein Herstad, Vemorkveien, 4300 Sandnes, Norway

[21] Appl. No.: 941,132

[22] Filed: Sep. 11, 1978

[51] Int. Cl.[2] ..... E01C 9/10

[52] U.S. Cl. ..... 404/36; 244/114 R; 169/54; 52/596

[58] Field of Search ..... 169/58, 54; 244/114 R; 404/36, 35, 34, 41; 52/596, 607

[56] References Cited

U.S. PATENT DOCUMENTS

| | | | |
|---|---|---|---|
| 70,076 | 10/1867 | Dean | 404/36 |
| 1,781,294 | 11/1930 | McCracken | 169/15 |
| 1,914,573 | 6/1933 | Koorogey | 244/114 R |
| 2,718,927 | 9/1955 | Dill | 169/44 |
| 3,063,502 | 11/1962 | Lakind | 169/54 |
| 3,096,956 | 7/1963 | Oestrich | 404/36 X |
| 3,645,177 | 2/1972 | Hargett | 244/114 R |
| 3,802,144 | 4/1974 | Spica | 404/36 X |
| 3,831,889 | 8/1974 | Deacon | 244/114 R |

FOREIGN PATENT DOCUMENTS

| | | | |
|---|---|---|---|
| 902654 | 8/1962 | United Kingdom | 244/114 R |

*Primary Examiner*—Nile C. Byers, Jr.
*Attorney, Agent, or Firm*—Young & Thompson

[57] ABSTRACT

A helicopter landing platform comprises a fine mesh grid supported on a coarse mesh grid above a horizontal surface such as an ordinary helicopter landing pad. The grid structure is supported in superposed spaced relationship by a supporting framework; and conduits and nozzles for foam fire extinguishing agent are disposed in the space between the grid work and the horizontal surface. Burning oil thus falls through the mesh and is extinguished by the foam, the mesh preventing the foam from blowing away and also providing an anti-skid surface for the helicopter. The platform can be subdivided into a number of units; and the periphery of the platform is surrounded by a rim.

3 Claims, 1 Drawing Figure

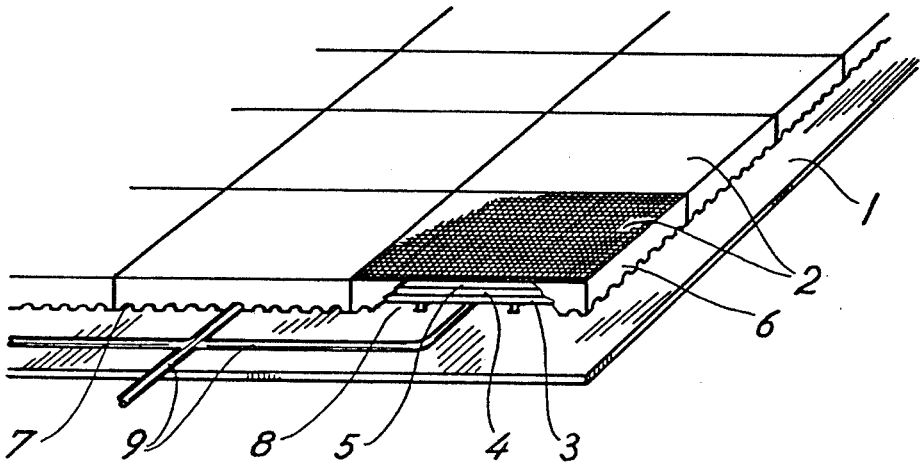
1
2
6
7
9
8
5
4
3

HELICOPTER LANDING PLATFORM

This invention concerns a helicopter landing platform.

Helicopter landing platforms are found in large numbers both offshore and on land, particularly related to the oil exploration industry. It is common practice on offshore drilling rigs and other marine installations to cover the landing platforms with a ropemesh to prevent the helicopters from slipping.

Should a helicopter become wrecked during the process of landing or take-off, the fire hazard is considerable. In case of a fire, burning fuel oil will most probably flow on to the landing platform and spread rapidly to surrounding areas. The anti-slip ropemesh will burn away. In windy conditions, the landing platform on the leeward side of the helicopter will be covered in flames. Under these circumstances, it is imperative for anyone on board the helicopter to get quickly out of the craft and through the flames on the landing platform to safety.

It is widely recognized that action taken during the first few instants of a fuel oil fire determines whether anyone on board the helicopter may be brought to safety and the fire put out.

Fire extinguishing equipment at existing helicopter landing platforms is mostly portable equipment stationed along the perimeter of the landing platform. If a fire occurs under windy conditions, areas of the landing platform leeward of the helicopter will be covered in flames, and it will be impossible to use fire extinguishing equipment stationed on this side of the helicopter.

Under windy conditions, foam-based fire extinguishing equipment is useless on existing landing platforms as the foam will be blown away by the wind instead of covering the fire and suffocating the flames. The only suitable fire fighting equipment is therefore powder-based. Water hoses are installed on all helicopter landing platforms, but water cannot be used to put out a fuel oil fire. Water may be used only for cooling purposes after the fire has been extinguished as hot materials may easily re-ignite the fuel oil.

In order to ensure a reasonable level of safety at existing helicopter landing platforms, a large number of portable fire extinguishers are required and also a large number of trained personnel to operate them.

The object of this invention is to provide a landing platform where burning fuel oil escaping from a wrecked helicopter will be suffocated as it meets the landing platform.

According to the invention, this is achieved by constructing a landing platform where a grid structure is placed above a level surface and said grid structure rests upon said surface by means of a supporting framework and a space is thus created between the grid structure and the surface below. A number of nozzles for fire extinguishing substances, particularly foam based, are mounted in the space between the grid structure and the surface below.

A further feature of the invention is that the grid structure and the supporting framework is surrounded by a rim.

A further feature of the invention is that the helicopter landing platform consists of several separate elements, each element consisting of grid structure, supporting framework, piping with nozzles for fire extinguishing substances, and surrounding rim.

One embodiment of the invention will now be described by way of example and with reference to the accompanying diagrammatic drawing, which shows in perspective a section of the helicopter landing platform in accordance with the invention and with part of the surrounding rim removed.

Reference numeral 1 on the drawing denotes a level surface, which could well be an ordinary known landing platform. On surface 1 rests a number of elements 2 which are positioned adjacent to each other and together make up the helicopter landing platform according to the invention. Each element 2 is constructed as follows: On its underside, the element 2 has a supporting framework 3 which rests on surface 1. A coarse-mesh grid structure 4 rests on the supporting framework 3. A fine-mesh grid structure 5 rests on the coarse-mesh grid structure 4 and forms the top surface of the helicopter landing platform. Framework 3 and grid structures 4 and 5 are surrounded by a rim 6 which has a number of openings 7 for drainage along its lower edge. In the space 8 between surface 1 and the coarse-mesh grid structure 4 is placed a network of pipes 9 with nozzles (not shown in the drawing) for fire extinguishing substances from a central foam producing plant (not shown in the drawing). A curved cover is placed above each nozzle, thus forcing the foam from the nozzle downwards to ensure that the elements 2 are filled first at bottom level and the foam then rises evenly in the elements 2. The fine-mesh grid 5 restricts the foam and prevents it from being forced through the top surface of the element before the element 2 has first been completely filled. Excess foam will thus be forced through the upper surface of element 2 as long as foam is supplied through the nozzles.

It will take only a few seconds to fill the elements 2 with foam once the foam producing plant starts supplying foam through the nozzles. Burning fuel oil from the wreckage of a helicopter on the landing platform will flow into the elements 2 and be suffocated instantaneously. The fuel oil will remain at the bottom of the elements 2 or it will be drained away. The elements 2 are of such height that any fuel oil at the bottom of the elements will be covered by a sufficiently thick layer of foam to avoid re-ignition. Wind, regardless of force, will not be able to blow away the foam in the elements 2.

Anyone on board a wrecked helicopter will be safe from the hazards of a fuel oil fire as soon as they get out of the craft and onto the foam-covered platform. Persons whose clothing is on fire may roll on the platform, where foam is constantly rising through the grid 5, and thus effectively extinguish burning clothes.

The helicopter landing platform is, according to the invention, also equipped with portable fire extinguishing equipment. This equipment may be used to fight the fire in the helicopter itself, a task greatly reduced as the landing platform will not be covered with burning fuel oil.

It is obvious that according to the invention, the helicopter landing platform need not be covered by a ropemesh to prevent the helicopter from slipping as the grid structure 5 provides a non-slip surface.

It is a considerable advantage that the landing platform according to the invention will always provide a dry landing surface, as rainwater cannot collect in large shallow pools of water as it often does on existing platforms.

A further advantage provided by the invention is that small quantities of lubrication oil which normally leak from helicopters stationary on the platform, will not collect on the surface and thus make it slippery, as is the case on existing landing platforms.

Should a helicopter experience any difficulties during flight, and an emergency landing can be foreseen, the landing platform can, of course, be covered by foam in advance and without any possibility of the foam being blown away. The same procedure may be followed if one is concerned with the danger arising from static electricity being discharged as a helicopter touches down on the landing platform.

From a consideration of the foregoing disclosure, therefore, it will be evident that the initially recited object of the present invention has been achieved.

Although the present invention has been described and illustrated in connection with the preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A helicopter landing platform, comprising a grid structure disposed above a level surface and resting on said surface by means of a supporting framework, thereby to create a space between the grid structure and said surface, and means in said space for introducing a fire extinguishing substance into said space, said grid structure comprising a fine mesh grid structure which rests on a coarse mesh grid structure.

2. A helicopter landing platform as claimed in claim 1, and a rim surrounding said grid structure and supporting framework.

3. A helicopter landing platform as claimed in claim 1, in the form of a plurality of separate elements in side-by side relationship each comprising a said grid structure, supporting framework, and fire extinguishing substance supply means.

* * * * *